United States Patent [19]

Vondergoltz et al.

[11] Patent Number: 4,694,628

[45] Date of Patent: Sep. 22, 1987

[54] METAL BUILDING PANEL WITH STANDING SEAM EDGE FORMATIONS

[75] Inventors: G. Earl Vondergoltz, Fulshear; Milton E. Hammack, Houston, both of Tex.

[73] Assignee: ECI Building Components, Inc., Stafford, Tex.

[21] Appl. No.: 854,097

[22] Filed: Apr. 21, 1986

[51] Int. Cl.[4] ..... E04D 1/18

[52] U.S. Cl. ..... 52/528; 52/520

[58] Field of Search ..... 52/394, 528, 529, 542, 52/519, 520

[56] References Cited

U.S. PATENT DOCUMENTS

| | | | |
|---|---|---|---|
| 4,192,117 | 3/1980 | Heirich | 52/542 |
| 4,213,292 | 7/1980 | Heckelsberg | 52/528 |
| 4,269,012 | 5/1981 | Mattingly | 52/542 |
| 4,361,998 | 12/1982 | Ellison et al. | 52/520 |
| 4,525,976 | 7/1985 | Simpson | 52/528 X |
| 4,575,983 | 3/1986 | Lott et al. | 52/528 X |

*Primary Examiner*—J. Karl Bell

*Attorney, Agent, or Firm*—Jones, Day, Reavis & Pogue

[57] ABSTRACT

A metal building panel, such as a roof panel, has its longitudinal edges roll-formed to define integral male and female edge formations. Each edge formation includes an upstanding flange, a return flange angularly disposed with respect to the upstanding flange such that the distal portion of the return flange is spaced from the upstanding flange a distance greater than the distances other portions of the return flange are spaced from the upstanding flange. Each of the return flanges joins with a reentrant rib. The reentrant rib of the female edge formation joins with a return lip. Adjoining male and female edge formations of a pair of such panels may be readily inter-engaged to form a snap-lock connection. If desired, a further mechanically seamed lock may be obtained by the application of squeezing forces to the inter-engaged male and female edge formations of a pair of such panels.

11 Claims, 4 Drawing Figures

FIG. 1
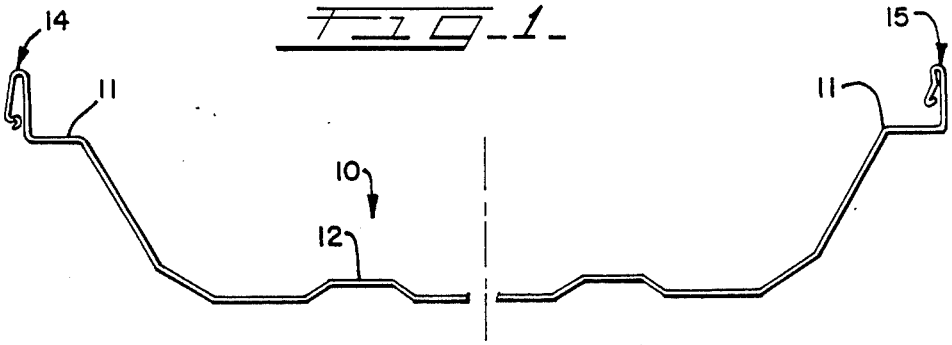
FIG. 2
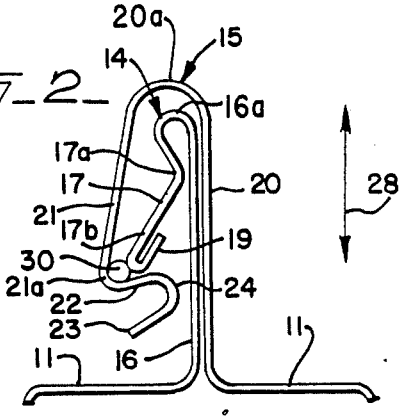
FIG. 3
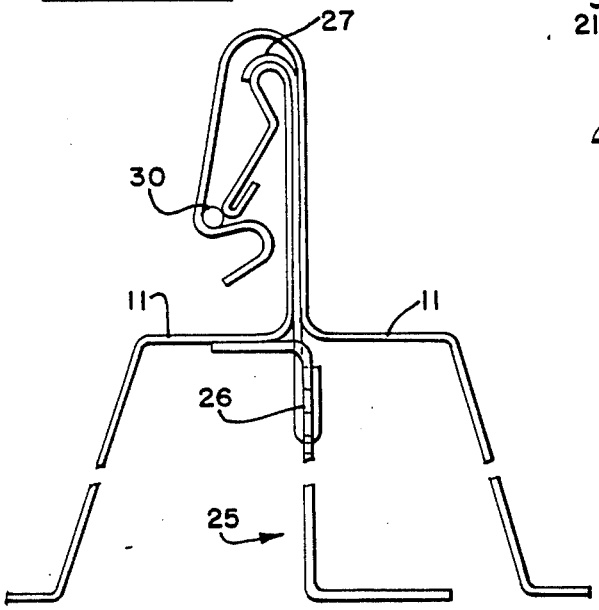
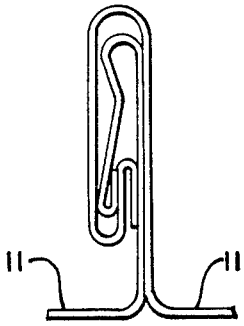
FIG. 4

METAL BUILDING PANEL WITH STANDING SEAM EDGE FORMATIONS

BACKGROUND OF THE INVENTION

The present invention relates to a metal building panel, such as roof panel, for example. In particular, the present invention relates to such a metal building panel which is of the type having integral edge formations configured to form a standing seam joint between adjoining pairs of such panels.

Metal building panels of the standing seam type are well known in the prior art. Representative U.S. Pat. Nos. showing such panels are: Owens 1,292,960; Strong 1,558,410; Thompson 3,771,482; Day 3,889,437; Yoder 4,168,596; Heckelsberg 4,193,247; Heckelsberg 4,213,282; and Heckelsberg 4,224,775.

The panels disclosed in the foregoing patents require the use of a seaming tool to crimp and deform the inter-engaged edges to form the standing seam joint. These seaming tools are rather expensive and consequently a typical metal building contractor will have only a limited supply of such tools. Thus, these tools must be transported from job site to job site. Very often, delays are encountered in the field because a seaming tool is not available at the time of erection of a roof, for example, of a metal building. Further, these seaming tools frequently become damaged in the field necessitating return to the contractor's shop for repairs causing, of course, delays in the erection process.

It is known in the prior art to provide metal building panels which do not require the use of such seaming tools. These metal panels are configured to provide a snap-lock which does not require significant bending or deformation of the panel edge formations. Representative prior art will be found in U.S. Pat. Nos.: Clemmer 970,885; Straus 3,511,011; Matlock 3,898,783; Wilson 3,982,373; and Reinwall 3,998,019.

Although the snap-lock type of panels have enjoyed substantial acceptance in the field, they do have some disadvantages. In this regard, very often the snap-lock achieved by these panels will not meet the specifications for a particular job that call for a more secure lock than can be achieved only by panels configured to be significantly crimped and deformed in the field by use of the rather expensive seaming tools referred to above. Consequently, the snap-lock type of panel has limited utility because in some instances it will not comply with the architect's specifications.

SUMMARY AND OBJECTS OF THE INVENTION

The present invention provides a metal building panel configured to form a snap-lock type of standing seam joint between adjacent panels and, if desired, a more secure lock which can be effected in the field by the use of a very simple and inexpensive seaming tool.

A primary object of the present invention is the provision of a metal building panel having its longitudinal edges roll-formed to define male and female edge formations such that adjoining edges of a pair of such panels may be readily and easily inter-engaged to form a snap-lock type of standing seam.

It is a further object of the present invention to provide a building panel of the type described whereby the inter-engaged male and female edge formations of a pair of such panels may be defomed in the field by the use of a very simple seaming tool to provide a further and more secure mechanical lock between the panels.

These and other objects and advantages of the invention will become apparent from a review of the following specification.

DESCRIPTION OF THE DRAWINGS

FIG. 1 is a transverse cross-section of a metal building panel made in accordance with the present invention, with the central portion being broken away to facilitate illustrating of the panel in a larger scale;

FIG. 2 is an enlarged end view of the inter-engaged male and female edge formations of a pair of like panels constructed in accordance with the present invention;

FIG. 3 is an enlarged end view similar to FIG. 2 and showing a clip which may be used to secure the panels to a purlin or other structural member; and FIG. 4 is an enlarged end view of the inter-engaged male and female edge formations of a pair of like panels constructed in accordance with the present invention and showing the edge formations after they have been deformed to form a mechanical lock between the adjacent panels.

DESCRIPTION OF THE INVENTION

Referring in particular to FIG. 1, a metal building panel, such as a roof panel, constructed in accordance with the present invention is generally designated 10. This panel is of unitary or one-piece construction and includes a body portion having a pair of co-planar portions 11. The remaining body portion 12 of the roof panel disposed between the portions 11 may be of any suitable configuration, but is preferably corrugated to aid in stiffening of the panel which will normally have a length considerably greater than the width of the panel. The panel 10 includes male and female edge formations generally designated 14 and 15, respectively, which extend from the planar portions 11.

Referring now to FIG. 2, the male edge formation 14 includes an upstanding flange 16 extending generally perpendicular to the plane of the panel member as represented by the co-planar portions 11. The upstanding flange 16 joins with a return flange 17 through an intermediate arcuate portion **16*a* bent at a suitable radius. It is noted that the return flange 17 is bent longitudinally thereof, as at 17*a*; the purpose of this bend will be explained below. The distal portion 17*b* of the return flange joins with and terminates in a re-entrant rib 19. It will be noted that the return flange 17 is angularly disposed with respect to the upstanding flange 16 such that the distal portion 17*b*** of the return flange is spaced from the upstanding flange a greater distance than the distances the other portions of the return flange are spaced from the upstanding flange.

The female edge formation 15 includes an upstanding flange 20 extending generally perpendicular to the plane of the panel member as represented by the co-planar sections 11. The upstanding flange 20 joins with a return flange 21 through an intermediate arcuate section **20*a* bent at a suitable radius. The return flange 21 has a distal portion 21*a* which joins with a re-entrant rib 22. It is noted that the return flange 21 is angularly disposed with respect to the upstanding flange 20 such that the distal portion 21*a* is spaced from the upstanding flange a distance greater than the other portions of the return flange 21 are spaced from the upstanding flange 20. The re-entrant rib 22 joins with a return lip 23 through an intermediate arcuate portion 24. It is noted that the reentrant rib extends toward the arcuate portions 16***a*, 20*a* obliquely to the upstanding flanges 16,20 and into the space defined by distal portion 17*b* and the upstanding flange 16. It will be apparent that the metal building panel of the present invention may be manufactured by conventional roll-forming machines.

Referring now to FIG. 3, the inter-engaged male and female edge formations are shown associated with a clip, generally designated 25. This clip has a base part 26 slidably supporting a hook part 27 which engages the rounded portion 16*a* of the male edge formation 14. The clip 25, which may be of the type disclosed, for example, in Heckelsberg U.S. Pat. No. 4,193,247, is used to secure the panels to the adjacent structural member, such as a purlin (not shown), if the panels of the present invention are used to form a standing seam roof.

FIGS. 2 and 3 illustrate panels of the present invention having the male and female edge formations inter-engaged to form a snap-lock type of standing seam. This snap-lock is achieved because the re-entrant rib 22 of the female edge formation will snap under and behind the re-entrant rib 19 of the male edge formation 14. It will be appreciated that this snap-lock can be readily achieved by moving a pair of the panels relative to each other generally along the line designated 28 in FIG. 2. This line of relative movement is generally perpendicular to the planar body portions of the panels. During this relative movement, the rounded portion 24 and return lip 23 of the female edge formation will ride along the outer surface of the return flange 17 of the male edge formation until the portions 23, 24 of the female edge formation snap under the distal portion 17*b* and re-entrant rib 19 of the male edge formation. Thus, this snap-lock may be achieved without rotating or manipulating one panel in any particular manner relative to an adjacent panel.

If it desired to form a more secure mechanical lock, such a lock can be readily achieved by applying a squeezing force to the inter-engaged male and female edge formations. Referring to FIG. 4, the inter-engaged male and female edge formations are illustrated after a squeezing force has been applied. During the initial portion of the squeezing operation, the return lip 23 and rounded portion 24 of the female edge formation will engage and slide along the upstanding flange 16 of the male formation thereby to inter-lock with the re-entrant rib 19 of the male edge formation. During this squeezing operation, the return flange 17 of the male edge formation will unbend or extend thereby to force the distal portion 17*b* and re-entrant rib 19 of the male edge formation into a tight nesting relationship with the distal portion 21*a* and return rib 22 of the female edge formation. Consequently, it is seen that a very secure mechanical lock is achieved upon the application of a squeezing force to the inter-engaged male and female edge formations.

The squeezing forces to achieve the mechanical lock may be provided in a number of ways. For example, the squeezing forces may be provided manually by the use of hand tools in the nature of pliers. Preferably, the squeezing forces will be provided by using a suitable seaming tool. It will be apparent to those skilled in the art that this tool need include only a suitable guide means and a single pair of rollers to achieve the mechanical lock configuration illustrated in FIG. 4. Because the present invention permits use of a very simple and consequently inexpensive seaming tool, a contractor may have a substantial number of these tools on hand thereby making it unnecessary to ship the tools to one job site immediately upon completion of work at another job site. It will be apparent this feature will avoid delays in the erection process.

In a preferred form of the invention, a strip of suitable caulking material 30 is disposed within the cavity in the female edge formation defined by the distal portion 21*a* and re-entrant rib 22. In both the snap-lock and mechanical lock configurations, this caulking strip will engage the distal portion 17*b* of the male edge formation to form a water-tight joint between adjacent panels constructed in accordance with the present invention.

Accordingly, it is seen that the present invention provides a metal building panel configured to form a snap-lock type of standing seam joint between adjacent panels and, if desired, a more secure lock which can be effected in the field by the use of very simple and inexpensive tools. While a particular embodiment of the invention has here been present by way of illustration, it will be understood that such embodiment is illustrative only and is not meant to be restrictive. Therefore, numerous changes and modifications may be made and the full use of equivalence resorted to without departing from the spirit or scope of the invention as defined by the following claims.

We claim:

1. A metal building panel of the type adapted to form a standing seam joint between an adjoining pair of said panels, said panel having longitudinal edges shaped to define integral male and female edge formations, each of said edge formations having an upstanding flange extending generally perpendicular to the plane of the panel member, each of said upstanding flanges being joined by an intermediate arcuate portion with a return flange disposed adjacent common sides of the respective upstanding flanges, the return flange of said female edge formation being joined with a reentrant rib which extends toward said intermediate arcuate portions obliquely to said upstanding flanges, and into the space defined between the distal portion of the return flange of the male edge formation and the upstanding flange of the male edge formation, whereby the reentrant rib of the female edge formation will snap under the distal portion of the return flange of the male edge formation and into said space when male and female edge formations of an adjoining pair of said panels are interengaged by relative movement along a line generally perpendicular to the planar body portions of the such pair of panels, and a return lip joined with the reentrant rib of the female edge formation and adapted to engage and slide along the upstanding flange of the male edge formation upon the application of a squeezing force thereby to extend farther into said space for forming a locking interengagement between an adjoining pair of said panels.

2. The metal building panel according to claim 1 wherein said return flange of the male edge formation is bent longitudinally thereof such that said male return flange will unbend upon the application of a squeezing action to inter-engaged male and female edge formations thereby to cause the distal edge portion of the return flange of the male formation to nest within the reentrant rib of the female edge formation for forming a mechanically seamed lock between a pair of said building panels.

3. The metal building panel according to claim 1 further defined by a reentrant rib joined with the return flange of the male edge formation.

4. The metal building panel according to claim 2 further defined by a reentrant rib joined with the return flange of the male edge formation.

5. The metal building panel according to claim 1 wherein the return flanges of the male and female edge formations are angularly disposed with respect to the associated upstanding flanges such that the distal portions of the return flanges are spaced from the upstanding flanges a greater distance than the distances the other portions of the return flanges are spaced from the upstanding flanges.

6. The metal building panel according to claim 2 wherein the return flanges of the metal and female edge formations are angularly disposed with respect to the associated upstanding flanges such that the distal portions of the return flanges are spaced from the upstanding flanges a greater distance than the distances the other portions of the return flanges are spaced from the upstanding flanges.

7. The metal building panel according to claim 3 wherein the return flanges of the male and female edge formations are angularly disposed with respect to the associated upstanding flanges such that the distal portions of the return flanges are spaced from the upstanding flanges a greater distance than the distances the other portions of the return flanges are spaced from the upstanding flanges.

8. The metal building panel according to claim 1 further defined by a caulking strip adhered to the female edge formation in the cavity formed by the reentrant rib and the return flange thereof.

9. The metal building panel according to claim 1 wherein the return lip of the female edge formation is shaped to engage the upstanding flange of the male edge formation to cause a mechanical interlock between the reentrant ribs of the male and female edge formations upon the application of a squeezing force to a pair of inter-engaged panels.

10. The metal building panel according to claim 2 wherein the return lip of the female edge formation is shaped to engage the upstanding flange of the male edge formation to cause a mechanical interlock between the reentrant ribs of the male and female edge formations upon the application of a squeezing force to a pair of inter-engaged panels.

11. The metal building panel according to claim 3 wherein the return lip of the female edge formation is shaped to engage the upstanding flange of the male edge formation to cause a mechanical interlock between the reentrant ribs of the male and female edge formations upon the application of a squeezing force to a pair of inter-engaged panels.

* * * * *

UNITED STATES PATENT AND TRADEMARK OFFICE

CERTIFICATE OF CORRECTION

PATENT NO. : 4,694,628

DATED : Sep. 22, 1987

INVENTOR(S) : G. Earl Vondergoltz and Milton E. Hammack

It is certified that error appears in the above-identified patent and that said Letters Patent is hereby corrected as shown below:

Col. 1, line 68, "defomed" should be --deformed--.

Col. 4, line 19, "present" should be --presented--.

Col. 5, line 13, "metal" should be --male--.

Signed and Sealed this

Third Day of May, 1988

*Attest:*

*Attesting Officer*

DONALD J. QUIGG

*Commissioner of Patents and Trademarks*